US005620399A

United States Patent [19]

Hofmann

[11] Patent Number: 5,620,399

[45] Date of Patent: Apr. 15, 1997

[54] GRIPPING SLEEVE FOR THE FIRM GRIP OF AN OBJECT

[76] Inventor: Norbert Hofmann, Knappertsbuschstr. 39, 81927 Munich, Germany

[21] Appl. No.: 524,156

[22] Filed: Aug. 16, 1995

Related U.S. Application Data

[63] Continuation of Ser. No. 121,496, Sep. 16, 1993, abandoned.

[51] Int. Cl.[6] ..... A63B 21/00; A41D 13/08

[52] U.S. Cl. ..... 482/49; 482/44; 2/20; 2/161.1

[58] Field of Search ..... 482/44, 49, 139, 482/92, 105–108; 273/DIG. 30, 176, 26 C; 2/20, 161.1, 161.3, 16, 159, 161.8, 161.6, 161.5; 602/21, 61, 62

[56] References Cited

U.S. PATENT DOCUMENTS

| | | | |
|---|---|---|---|
| 2,205,957 | 6/1940 | Kinkis | 2/20 |
| 2,235,313 | 3/1941 | Cleveland | 2/20 |
| 3,262,702 | 7/1966 | Kovacs | 2/20 |
| 3,324,818 | 6/1967 | Dunlap | 273/166 |
| 3,501,773 | 3/1970 | Stansberry | 273/166 |
| 3,896,498 | 7/1975 | Pang | 273/166 |
| 4,617,684 | 10/1986 | Green et al. | 2/20 |
| 4,754,499 | 7/1988 | Pirie | 2/20 |
| 5,004,226 | 4/1991 | Brown | 482/137 |
| 5,081,715 | 1/1992 | Mascia | 2/20 |
| 5,261,299 | 11/1993 | Kondos | 2/20 |

FOREIGN PATENT DOCUMENTS

| | | |
|---|---|---|
| 8430446 | 4/1985 | Germany . |
| 3427718 | 1/1986 | Germany . |
| 3443429 | 8/1986 | Germany . |
| 9016482 | 4/1991 | Germany . |

*Primary Examiner*—Jerome Donnelly
*Attorney, Agent, or Firm*—Sixbey, Friedman, Leedom & Ferguson, P.C.; David S. Safran

[57] ABSTRACT

Gripping sleeve for tightly gripping an object by hand, particularly fitness machines and equipment. A plate (1) is made of a tightly gripping or clinging material, such as a cellular rubber, which is connected by a web (2) to a wrist band (3).

16 Claims, 1 Drawing Sheet

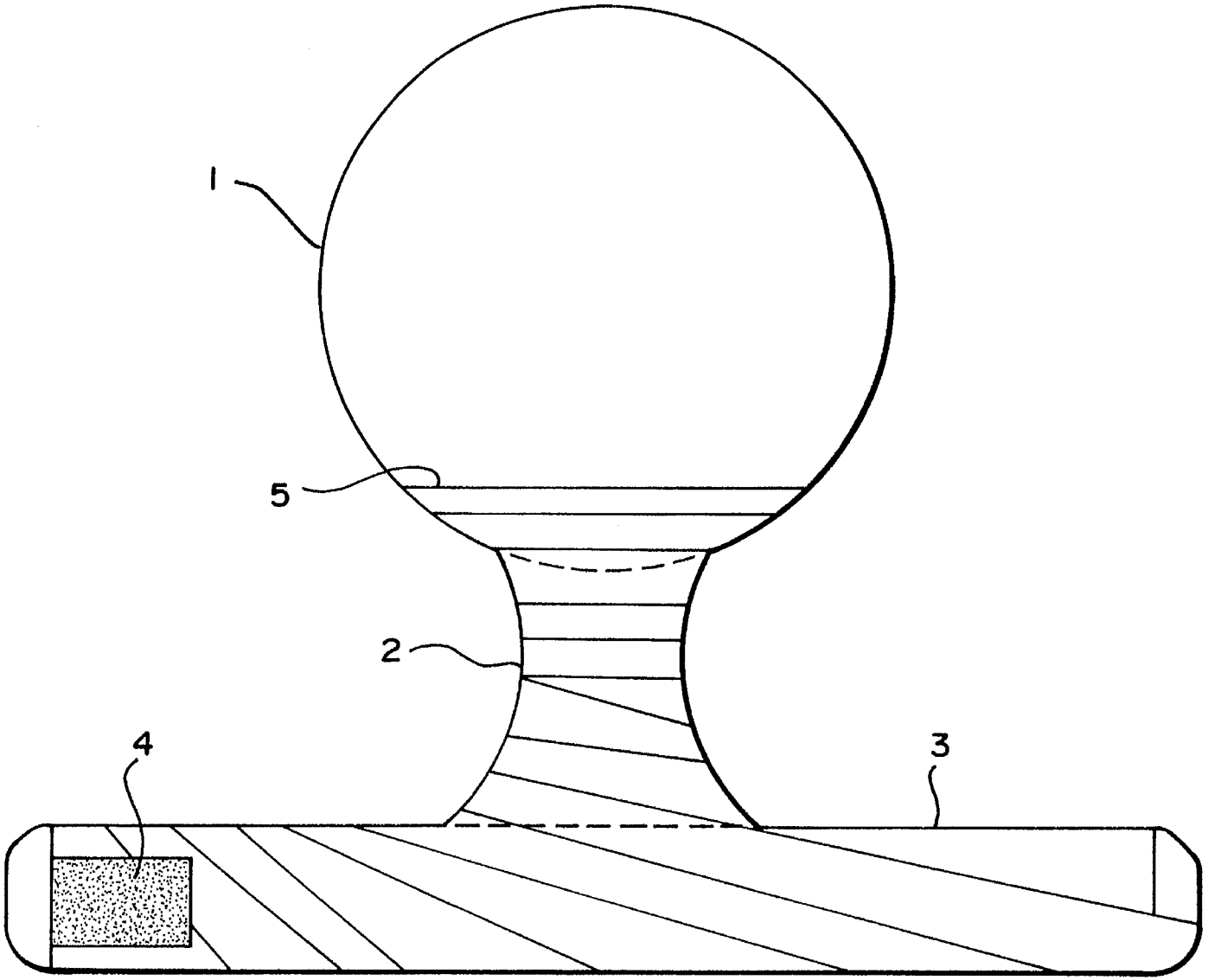
1
5
2
4
3

GRIPPING SLEEVE FOR THE FIRM GRIP OF AN OBJECT

This application is a Continuation of Ser. No. 08/121,496, filed Sep. 16, 1993, now abandoned.

DESCRIPTION

1. Field of the Invention

The invention is directed to a gripping sleeve for the firm gripping of an object, such as a fitness machine or similar equipment, by hand.

2. Background of the Invention

It is frequently necessary to firmly grasp an object. In doing so, it is important that there is no danger that the handle of the object becomes loose or slips while working with the handle, for example, due to perspiration on the user's hands or due to the smoothness or slippery nature of the surface being gripped.

When working out at a gym or when engaged in sports using machines or devices, such as working out with dumbbells, for example, it is extremely important that the user can safely and securely hold onto the equipment throughout the entire period of use. Otherwise, there is a high risk of injury for the person involved.

SUMMARY OF THE INVENTION

The invention provides a gripping sleeve which insures that the user will be able to firmly and safely grip an object. In particular, the gripping sleeve of the present invention is formed of a plate formed of a tightly gripping or clinging material, the plate being connected to a wrist band by a connecting web. The gripping sleeve can be put on a user's wrist with the wrist band, so that the plate lies in the palm of his or her hand. In this way, a firm gripping of the object is obtained due to the presence of the plate covered by the tightly gripping or clinging material between the palm of the user's hand and the objected being grasped.

BRIEF DESCRIPTION OF THE DRAWING

The sole FIGURE is a top view of an embodiment of the gripping sleeve of the present invention.

DETAILED DESCRIPTION OF THE PREFERRED EMBODIMENT

The gripping sleeve of the illustrated embodiment of the present invention is, basically shaped like a "T". In other words, the gripping sleeve is formed of a plate 1, a connecting web 2 and a wrist band 3 which, preferably, formed of one or two pieces covered by a tightly gripping or clinging material. In the embodiment in which the gripping sleeve is formed of two pieces, the connecting web and the wrist band can be opened and closed with a snap type fastener. The plate 1 is, preferably, in the shape of a circle; however, plate 1 can also be a circle which is enlarged on a side to provide special protection for the user's thumb.

The diameter of the plate 1 is such that its free end, i.e., the end furthest from the wrist band 3, terminates just before the fingertips. In this way, the plate 1 closes exactly at the end of the fingertips when an object is gripped by the hand it is on instead of extending beyond the wearer's palm.

The length of the web depends on the size of the gripping sleeve, which is made in different sizes for use with by people having different size hands, e.g., one size for large hands and one size for small hands. Preferably, the gripping sleeves will be made in pairs with a gripping sleeve for each of the wearer's left and right hands.

The wrist band 3 can be made in one piece or as a flat ribbon with an opening and closing means on the flat ribbon, as shown in the drawing. The opening and closing means can be VELCRO® hook and loop material strips which can be either glued or sewn on to the wrist band. The wrist band 3 can support the wrist and serves as a strengthening band in this manner.

The joint between the web 2 and the wrist band 3 can be placed in the middle, as shown in the drawing or can be located elsewhere, such as at the end of the wrist band 3.

The thickness of the gripping sleeve, which means the thickness of the tightly gripping or clinging material of which it is formed, is 5–6 mm±10%. The gripping sleeve can be punched out of a continuous layer of the tightly gripping or clinging material, which can be a cellular rubber, in particular EPDM-cellular rubber. As for other dimensions of the gripping sleeve, for example, the circular plate 1 can have a diameter of 12 cm, the connecting web 2 can vary from 3–4 cm along its length which can be 5.6 cm long, and the wrist band 3 can be 3 cm wide and have a length of 26 cm when open.

In order to avoid tearing of the material while using the gripping sleeve, especially on fitness machines, a crackproof strengthening material 5 or a special rubber color or fabric covering at least is applied on at least one side of the gripping sleeve covering the wrist band 3, the web 2 and the following part of the plate 1 up to the actual gripping area (represented as a strip wrapped around this portion of the gripping sleeve in the drawing). This crackproof strengthening material 5, preferably, is textile nylon with a PVC coating, and especially, nylons of 30 g of nylon per meter and 200 g of PVC coating per meter having 9–17 threads per centimeter and a yarn strength of 200 to 210 TD. In the embodiment using a two piece construction, the plate will be covered with the special rubber color or fabric covering while the wrist band is formed of an nonstretchable cotton or cellulose.

The cellular rubber used for the gripping sleeve should provide high friction, i.e., high adhesion, and should not irritate the skin. Furthermore, the cellular rubber should be flexible, being adaptable in shape with the ability to return to its original shape. It is advantageous if the material is able to absorb moist. Such materials include cellular rubbers of the type which are known for use as technical seals, for example.

I claim:

1. Gripping sleeve for tight gripping of a part of exercise machines and equipment by hand, said gripping sleeve consisting of a plate extending away from a wrist band said plate and said wristband being connected in a cantilevered manner by a flexible connecting web; wherein the plate is made of a tightly clinging material; and wherein said wrist band forms the sole means for attachment of the plate and said connecting web to a user's wrist wherein said tightly clinging material is a substantially flat resiliently flexible moisture absorbent cellular rubber having a sufficiently high coefficient of friction to function as a means for preventing slippage between the plate and said part being gripped therewith; and wherein said wrist band is formed of a nonstretchable textile material forming a flexible strengthening means for the user's wrist.

2. Gripping sleeve according to claim 1, wherein the plate, the connecting web and the wrist band are all formed from a single piece of said tightly clinging material.

3. Gripping sleeve according to claim 2, wherein the wrist band is provided with means for opening and closing thereof.

4. Gripping sleeve according to claim 2, wherein the tightly clinging material is a cellular rubber.

5. Gripping sleeve according to claim 2, wherein the tightly clinging material is an EPDM cellular rubber.

6. Gripping sleeve according to claim 2, wherein the wrist band, the connecting web and a portion of the plate near the connecting web are covered with a crackproof strengthening material coating on at least one side thereof.

7. Gripping sleeve according to claim 6, wherein the strengthening material coating is a material selected from the group consisting of a textile nylon with a PVC coating, a flexible rubber color or fabric paint.

8. Gripping sleeve according to claim 1, wherein the wrist band is provided with means for opening and closing thereof.

9. Gripping sleeve according to claim 1, wherein the tightly clinging material is a cellular rubber.

10. Gripping sleeve according to claim 1, wherein the tightly clinging material is an EPDM cellular rubber.

11. Gripping sleeve according to claim 1, wherein the wrist band, the connecting web and a portion of the plate near the connecting web are covered with a crackproof strengthening material coating on at least one side thereof.

12. Gripping sleeve according to claim 1, wherein said wrist band is detachably connected to said connecting web by a snap type fastener.

13. Gripping sleeve for tight gripping of a part of execise machines and equipment by hand, said gripping sleeve consisting of a flat sheet of resiliently flexible, tightly gripping or clinging material having a sufficient coefficient of friction to prevent slippage between the sheet and the part being gripped therewith, a flexible wrist band which forms the sole means for attaching the gripping sleeve to a user's wrist; wherein said flat sheet has a gripping portion for covering a palm and finger portions of a user, and a flexible connecting web portion which projects from said gripping portion and is detachably connected to said wrist band.

14. Gripping sleeve according to claim 13, wherein the material of said sheet is a moisture-absorbent cellular rubber.

15. Gripping sleeve according to claim 13, wherein the wrist band is formed of a nonstretchable textile material.

16. Gripping sleeve according to claim 13, wherein the gripping portion has a substantially circular shape.

* * * * *